US008045722B2

(12) United States Patent
Choi et al.

(10) Patent No.: US 8,045,722 B2
(45) Date of Patent: Oct. 25, 2011

(54) METHOD OF AND APPARATUS FOR CONTROLLING SOUND FIELD THROUGH ARRAY SPEAKER

(75) Inventors: Jung-woo Choi, Hwaseong-si (KR); Young-tae Kim, Seongnam-si (KR); Jung-ho Kim, Yongin-si (KR); Sang-chul Ko, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 847 days.

(21) Appl. No.: 12/149,374

(22) Filed: Apr. 30, 2008

(65) Prior Publication Data

US 2009/0154723 A1 Jun. 18, 2009

(30) Foreign Application Priority Data

Dec. 18, 2007 (KR) ..... 10-2007-0133706

(51) Int. Cl.
*H04R 5/02* (2006.01)
*H04R 25/00* (2006.01)

(52) U.S. Cl. ..... 381/58; 381/80; 381/98; 381/99; 381/100; 381/123; 381/124; 381/182; 381/346; 381/347; 381/357; 381/358; 700/55; 700/68; 700/94

(58) Field of Classification Search ..... 381/58, 381/80, 98, 99, 100, 123, 124, 182, 346, 381/357, 358; 700/55, 68, 94
See application file for complete search history.

(56) References Cited

U.S. PATENT DOCUMENTS

| | | | | |
|---|---|---|---|---|
| 7,158,643 | B2 * | 1/2007 | Lavoie et al. | 381/58 |
| 7,769,183 | B2 * | 8/2010 | Bharitkar et al. | 381/59 |
| 2009/0141915 | A1 * | 6/2009 | Ko et al. | 381/182 |
| 2010/0150382 | A1 * | 6/2010 | Ko et al. | 381/303 |

* cited by examiner

*Primary Examiner* — Dao H Nguyen
(74) *Attorney, Agent, or Firm* — Staas & Halsey LLP

(57) ABSTRACT

Provided are a method and apparatus for controlling a sound field through an array speaker. The method includes calculating a coefficient of a filter that controls sound pressure of an input signal, based on a sound pressure ratio of a suppression area that suppresses sound emitted from an array speaker and an emphasis area that emphasizes the sound, and sound pressure efficiency in the emphasis area, generating a plurality of output signals that focuses the sound to the emphasis area by filtering the input signal based on the calculated coefficient of the filter, and outputting a sound field controlled sound based on the generated plurality of output signals. Accordingly, a listener in a predetermined direction and distance from the array speaker can clearly hear sound, without wearing an earphone or a headset so as to focus the sound only to the listener.

17 Claims, 5 Drawing Sheets

METHOD OF AND APPARATUS FOR CONTROLLING SOUND FIELD THROUGH ARRAY SPEAKER

CROSS-REFERENCE TO RELATED APPLICATIONS

This application claims the benefit of Korean Patent Application No. 10-2007-0133706, filed on Dec. 18, 2007, in the Korean Intellectual Property Office, the disclosure of which is incorporated herein in its entirety by reference.

BACKGROUND OF THE INVENTION

1. Field

One or more embodiments of the present invention relates to a method, medium, and apparatus for controlling a sound field in an array speaker system including a plurality of speakers, and more particularly, to a method, medium, and apparatus for controlling a sound field which can transmit sound only to a listener in a predetermined area by controlling a sound field in such a way that sound outputted from an array speaker is focused on the predetermined area.

2. Description of the Related Art

An array speaker is used to control direction of sound reproduced by combining a plurality of speakers or transmit sound to a predetermined area. Based on a principle of transmitting sound, generally called directivity, a plurality of sound source signals are transmitted to a predetermined direction by overlapping the sound source signals so that the strength of the sound source signals increases towards the predetermined direction by using phase differences of the sound source signals. Accordingly, such directivity is realized by disposing a plurality of speakers based on predetermined locations, and controlling sound source signals outputted from each speaker forming an array.

Recently, as various mobile digital devices are commercialized, consumption of speakers that can reproduce sound signals is increased. Accordingly, expectations and desires of users regarding a sound reproducing function of mobile digital devices are also increased. In other words, an advanced speaker technology is required, for example, a conventional mono speaker is developed into a stereo speaker, and a stereo speaker is developed into an array speaker with multi-channels. Specifically, as portable sound devices, such as miniaturized digital devices like a digital multimedia broadcasting (DMB) devices, portable multimedia players (PMPs), and mobile phones for image communication are popularized, a focusing technology, which focuses sound to a predetermined area desired by a user by using an array speaker is required. An area formed so that only a listener can listen to sound by such focusing technology is called a personal sound zone.

SUMMARY OF THE INVENTION

Additional aspects and/or advantages will be set forth in part in the description which follows and, in part, will be apparent from the description, or may be learned by practice of the invention.

One or more embodiments of the present invention provides a method, medium, and apparatus for controlling a sound field through an array speaker, which can prevent displeasure of a listener who does not want to hear sound outputted from an array speaker caused while transmitting the sound to listeners around the array speaker, and solve discomfort of wearing an earphone or a headset to hear the sound.

According to an aspect of the present invention, there is provided a method of controlling a sound field, the method including: calculating a coefficient of a filter that controls sound pressure of an input signal, based on a sound pressure ratio of a suppression area that suppresses sound emitted from an array speaker and an emphasis area that emphasizes the sound, and sound pressure efficiency in the emphasis area; generating a plurality of output signals that focuses the sound to the emphasis area by filtering the input signal the calculated coefficient of the filter; and outputting a sound field controlled sound based on the generated plurality of output signals.

According to another aspect of the present invention, there is provided a computer readable recording medium having recorded thereon a program for executing the method above.

According to another aspect of the present invention, there is provided an apparatus for controlling a sound field, the apparatus including: a filter coefficient calculator, which calculates a coefficient of a filter that controls sound pressure of an input signal, based on a sound pressure ratio of a suppression area that suppresses sound emitted from an array speaker and an emphasis area that emphasizes the sound, and sound pressure efficiency in the emphasis area; a signal generator, which generates a plurality of output signals that focuses the sound to the emphasis area by filtering the input signal based on the calculated coefficient of the filter; and an output unit, which outputs a sound field controlled sound based on the generated plurality of output signals.

According to another aspect of the present invention, there is provided method for controlling a sound field for a speaker array, including: controlling the sound field based on a sound pressure ratio and sound pressure efficiency in an emphasis area; and outputting a sound field controlled sound through the speaker array.

BRIEF DESCRIPTION OF THE DRAWINGS

These and/or other aspects and advantages will become apparent and more readily appreciated from the following description of the embodiments, taken in conjunction with the accompanying drawings in which.

DETAILED DESCRIPTION OF THE PREFERRED EMBODIMENTS

Figure 1:
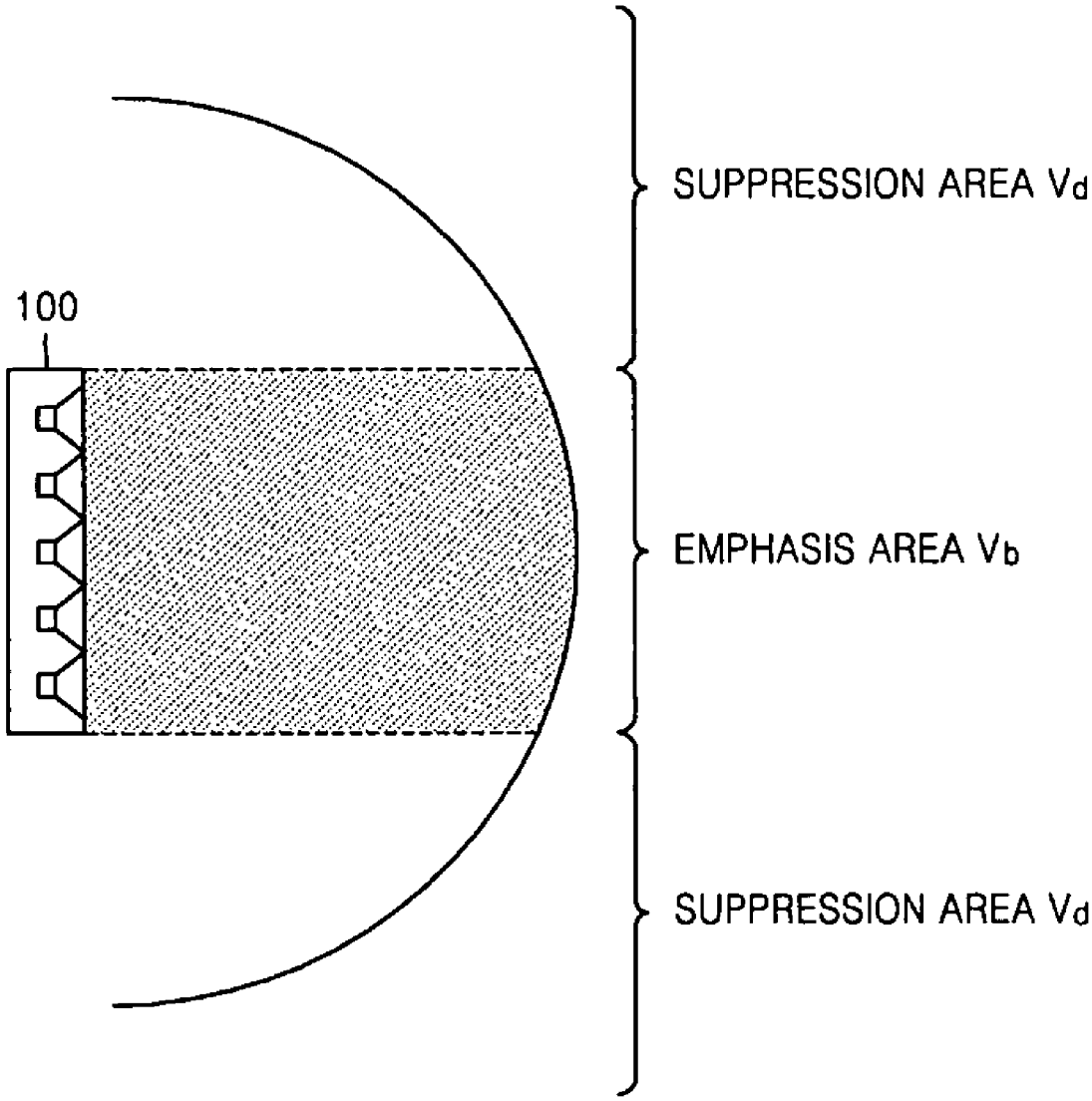
FIG. 1 is a diagram illustrating sound transmission areas around an array speaker for describing a problem that is to be solved by the present invention.

Reference will now be made in detail to the embodiments, examples of which are illustrated in the accompanying drawings, wherein like reference numerals refer to the like elements thereof. The embodiments are described below to explain the present invention by referring to the figures.

Hereinafter, one or more embodiments of the present invention will be described more fully with reference to the accompanying drawings, in which various embodiments of the invention are shown. While describing following embodiments, a sound source is a source from which sound is emitted, and denotes an individual speaker forming an array speaker, sound pressure denotes sound energy in a physical quantity of pressure, and a sound field denotes an area affected by the sound pressure around the sound source.

FIG. 1 is a diagram illustrating sound transmission areas around an array speaker 100 for describing a problem that is to be solved by the present invention. In FIG. 1, sound emitted from the array speaker 100 is transmitted to a forward area and a partial side of the array speaker, and thus various listeners around the array speaker 100 have to hear the sound regardless of their desire. Accordingly, in following embodiments that will be described, an area around the array speaker 100 is divided into an emphasis area and a suppression area so as to control energy distribution of the sound emitted through the array speaker 100.

The emphasis area means an area to which the sound is to be emphasized and transmitted, and is also referred to as a bright area. Such emphasis area is an area to which a sound signal with emphasized sound pressure is to be transmitted by controlling directivity of the array speaker 100. Meanwhile, the suppression area means an area to which the sound is suppressed and not easily transmitted, and is also referred to as a dark area. Unlike the emphasis area, the suppression area is an area to which the sound signal is not easily transmitted by suppressing the directivity of the array speaker 100.

In FIG. 1, it is assumed that the sound signal is transmitted only to a listener in a front direction of the array speaker, and the front direction is the emphasis area and the remaining directions are the suppression areas. The directivity for the emphasis area and the suppression area can be controlled by adjusting delay values of signals applied to individual speakers forming the array speaker 100, or by changing various directivity parameters, and this is well known to one of ordinary skill in the art.

In the following embodiments, following two criteria are used to determine whether the sound is satisfactorily focused on the emphasis area based on the emphasis area and the suppression area of FIG. 1, for example.

A first criterion is a level difference between sound pressure of the emphasis area and sound pressure of the suppression area. A level difference of sound pressure can be expressed in a ratio of the sound pressure of the emphasis area to the sound pressure of the suppression area. If the sound pressure ratio is high, it means that sound energy transmitted to the suppression area is relatively low compared to sound energy transmitted to the emphasis area. In other words, when the sound pressure ratio of the emphasis area to the suppression area is high, it means that the sound is satisfactorily focused on the emphasis area.

A second criterion is sound pressure efficiency in the emphasis area. The sound pressure efficiency can be expressed in a ratio of a size of the sound pressure of an output signal to a size of the sound pressure of an input signal. Specifically, considering that embodiments of the present invention are intended to focus the sound on the emphasis area, the output signal is an output signal of the emphasis area. In other words, high sound pressure efficiency means that most energy of the input signal can be used in forming a sound field of the emphasis area while minimizing the loss of the input signal.

Reasons for determining the focusing of the sound through above criteria are as follows.

When the focusing of the sound is determined only with the sound pressure ratio, which is the first criterion, a relative ratio may be a problem because the sound pressure ratio denotes a ratio of the relative sound pressure of the emphasis area to the sound pressure of the suppression area, and thus the same sound pressures in various environments of the embodiments of the present invention do not guarantee the same sound pressure of the emphasis area. For example, under two different environments, even if the sound pressure ratios are the same, the sound pressures of the emphasis areas may be different. In other words, even if the sound pressure ratio is sufficiently high for focusing the sound, a sound field having enough energy for a listener in the emphasis area to hear the sound emitted from the array speaker 100 may not be formed. If the sound pressure of the suppression area is very small, the sound pressure ratio could be sufficiently high even when the sound pressure in the emphasis area is too low for a listener to hear. Also, in order to cancel out the sound from being transmitted to the suppression area, control energy consumption may be unnecessarily increased. Accordingly, it is insufficient to determine the focusing of the sound only based on the sound pressure ratio.

In order to solve above problem, a method of increasing the absolute sound pressure of energy of the emphasis area in regards to energy consumed in controlling the sound pressure. However in this case, another problem occurs because as the absolute sound pressure focused on the emphasis area increases, a sound pressure level may also be increased in areas except the emphasis area (including the suppression area). In order to suppress a space with high sound pressure level, an array speaker whose wavelength is larger than a control frequency is required. In this case, realization of an array speaker system including a sound field controlling apparatus may be physically restricted. The physical restriction according to the size of an array speaker may specifically cause a problem to a low frequency signal.

Accordingly in embodiments of the present invention, a sound field is controlled by using the combination of the sound pressure efficiency in the emphasis area (second criterion) and the sound pressure ratio (first criterion) so as to focus sound even in a low frequency signal while obtaining a sufficient sound pressure level difference by using the minimum speaker output. Structures and realization processes of the embodiments of the present invention will now be described in detail.

Figure 2:
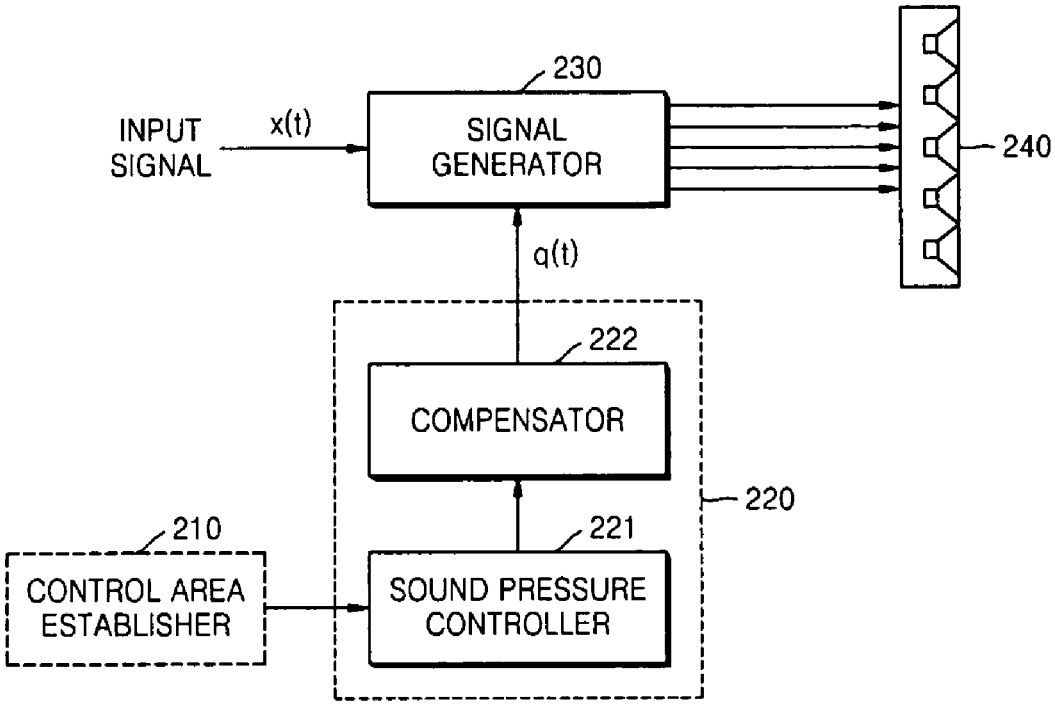
FIG. 2 is a block diagram illustrating an apparatus for controlling a sound field in an array speaker system according to an embodiment of the present invention.

FIG. 2 is a block diagram illustrating an apparatus for controlling a sound field in an array speaker system according to an embodiment of the present invention. The apparatus includes a control area establisher 210, a filter coefficient calculator 220, a signal generator 230, and an output unit 240. The filter coefficient calculator 220 may include a sound pressure controller 221 and a compensator 222.

The control area establisher 210 establishes control areas, i.e. a suppression area and/or an emphasis area, from areas around an array speaker, and supplies location information about the established control areas to the filter coefficient calculator 220. The control area establisher 210 can establish the suppression area and/or the emphasis area via various methods, such as receiving coordinates of a predetermined area in an area whose sound field is to be controlled from a user, or selecting at least one area from among a plurality of pre-set areas. If such control areas are not required to be established but pre-established, the control area establisher 210 may not be included.

The control area establisher 210 may establish the emphasis area without separately establishing the suppression area, and the number of the emphasis area may be more than one. Also, the location information may be shown by using coordinate values or as a distance and direction from the array speaker 240. Such location information is transmitted to the filter coefficient calculator 220 as a parameter for indicating the control area(s).

The filter coefficient calculator 220 calculates a coefficient of a filter controlling sound pressure of an input signal based on a sound pressure ratio of the emphasis area, emphasizing sound emitted from the array speaker, to the suppression area, suppressing the sound, and sound pressure efficiency in the emphasis area. As described above, a sound filed is controlled by combining two criteria, the sound pressure ratio and the sound pressure efficiency. This will be described in detail with reference to FIG. 3.

Figure 3:
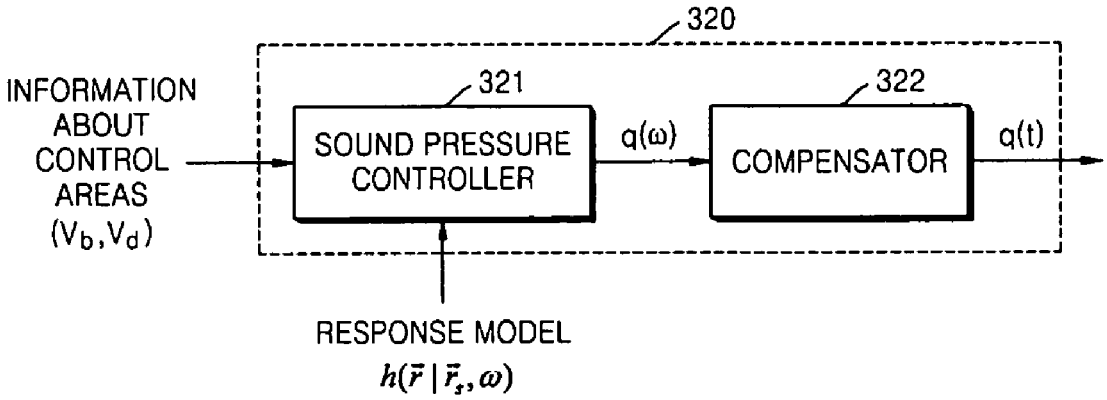
FIG. 3 is a block diagram illustrating a filter coefficient calculator in an apparatus for controlling a sound field according to an embodiment of the present invention.

FIG. 3 is a block diagram illustrating a filter coefficient calculator 320 in an apparatus for controlling a sound field according to an embodiment of the present invention. The filter coefficient calculator 320 includes a sound pressure controller 321 and a compensator 322. It is noted that the coefficient calculator 220 and the filter coefficient calculator 320, the sound pressure controller 221 and the sound pressure controller 321, and the compensator 222 and the compensator 322 are may be the same to the each other, respectively.

The sound pressure controller 321 receives information about control areas, which includes an emphasis area and/or a suppression area, and determines a coefficient of a filter that controls sound pressure by combining sound pressure ratio and sound pressure efficiency calculated from a response model between an array speaker and the control areas. In other words, the criteria for determining focusing of sound, i.e. the sound pressure ratio and the sound pressure efficiency are criteria for determining the coefficient of the filter in the current embodiment of the present invention. In the response model, a relationship from a predetermined input to output is expressed in a standardized model, such as a transmission function. According to an embodiment of the present invention, a sound signal outputted from the array speaker is an input, and a sound signal in a location (hereinafter, referred to as a field point) that is a predetermined distance away from the array speaker is an output. In other words, the response model shows correlation between a sound signal outputted from an array speaker and sound pressure in a field point from the array speaker in a function via physical variables between the array speaker and the field point.

A theoretical method, an experimental method, or an analytic method can be used in order to obtain the response model for the sound signal emitted from the array speaker. Above methods are obvious to one of ordinary skill in the art, and thus only the theoretical method and the experimental method will now be described in brief.

First in the theoretical method, a sound model is formed by using a sound propagation relationship between an array speaker and a location that is a predetermined distance away from the array speaker. When sound pressure in one field point that is a predetermined distance away from one of sound sources forming the array speaker is obtained, the obtained sound pressure is integrated by the size of the array speaker so as to obtain sound pressure formed through a plurality of sound sources, i.e. the array speaker.

Second in the experimental method, a predetermined sound source signal is applied to one of individual speakers forming the array speaker, and the predetermined sound source signal is outputted through the corresponding speaker. Here, the predetermined sound source signal denotes a test sound source used to measure an output sound source signal, and examples of such predetermined sound source signal include an impulse signal and white noise in which all frequency components are uniformly included. In a field point, the predetermined sound source signal outputted from the corresponding speaker is measured by using a measurer, such as a microphone array. Such measuring process can be repeatedly performed in a plurality of speakers forming the array speaker, and thus a response model for sound pressure of the array speaker can be obtained based on the measured predetermined sound source signals.

The sound pressure controller 321 calculates the coefficient of the filter controlling the sound field based on the response model obtained as above. Here, the filter controlling the sound field is a multichannel filter corresponding to the number of output channels of the array speaker, and thus calculating the coefficient of the filter means that a plurality of channel coefficients is calculated. Processes of calculating coefficients of a multichannel filter will now be described in detail with reference to FIGS. 4 through 6.

Figure 4:
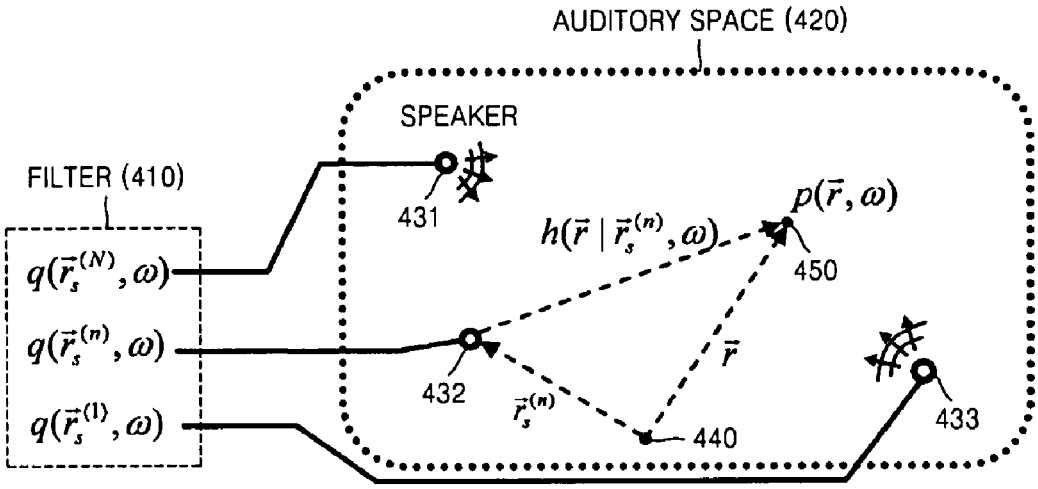
FIG. 4 is a diagram for describing a response model of an array speaker in an apparatus for controlling a sound field according to an embodiment of the present invention.

FIG. 4 is a diagram for describing a response model of an array speaker in an apparatus for controlling a sound field according to an embodiment of the present invention, and illustrates a multichannel array speaker system in a frequency domain. In FIG. 4, signals filtered through a filter 410 are applied to a plurality of speakers 431, 432, and 433 forming the array speaker. The filter 410 is a multichannel filter including N channels, and each channel of the filter 410 corresponds to the speakers 431, 432, and 433.

When the signals applied to the speakers 431, 432, and 433 are emitted, the signals can be expressed as the sound pressure in a predetermined field point 450 in auditory space 420 according to a response model of the array speaker. When sound is outputted through the speakers 431, 432, and 433, the sound pressure in the field point 450 that is F away from an original point 440 showing the center of the array speaker can be a multiplication of the response model of the speaker and a coefficient of a filter. Addition of sound pressures of individual speakers forming an array speaker is as shown in Equation 1 below.

$$p(\vec{r}, \omega) = \sum_{n=0}^{N-1} h(\vec{r} \mid \vec{r}_s^{(n)}, \omega) q^{(n)}(\omega) \qquad \text{Equation 1}$$

Here, $p(\vec{r},\omega)$ denotes the sound pressure, $\vec{r}$ denotes a vector from the original point 440 to the field point 450, $\omega$ denotes a frequency, and $h(\vec{r} \mid \vec{r}_s^{(n)}, \omega)$ denotes the response model of the array speaker. $q^{(n)}(\omega)$ denotes the coefficient of the multichannel filter, corresponding to n-th speaker from among the plurality of speakers forming the array speaker. In other words, Equation 1 is the sound pressure of the sound signal outputted from the array speaker.

When the sound pressure of Equation 1 is expressed in a vector, it can be shown as Equation 2 below.

$$p(\vec{r},\omega)=h(\vec{r} \mid \vec{r}_s)q \qquad \text{Equation 2}$$

Hereinafter, a sound pressure ratio and sound pressure efficiency, which are criteria for determining a coefficient of a filter as described above, will be calculated by using the sound pressure in a vector form as Equation 2. Accordingly, sound pressure in a control area is first expressed via an average of sound energy. Here, the average is obtained via mathematic calculation using a field point in the control areas established above.

An average of sound energy in an emphasis area can be calculated as Equation 3 below.

$$e_b = \langle |p(\vec{r}, \omega)|^2 \rangle_{V_b} = q^H \frac{1}{V_b} \int_{V_b} h(\vec{r} \mid \vec{r}_s)^H h(\vec{r} \mid \vec{r}_s) dV q = q^H R_b q \quad \text{Equation 3}$$

Here, $h(\vec{r} \mid \vec{r}_s)^H$ denotes a Hermitian transpose of $h(\vec{r} \mid \vec{r}_s)$, and $R_b$ denotes spatial correlation. $V_b$ denotes the emphasis area, and thus Equation 3 is the average of the sound energy calculated from the sound pressure of the emphasis area.

The sound pressure efficiency, i.e. the second criterion for determining a coefficient of a filter used in the embodiments of the present invention as described above, can be expressed as Equation 4 by using Equation 3. The sound pressure efficiency of Equation 4 is a ratio of an energy size, i.e. means sound pressure, of the emphasis area to an energy size of an input signal.

$$\alpha = \frac{e_b}{e_{bmax}} = \frac{q^H R_b q}{\|R_b\|^2 q^H q} \quad \text{Equation 4}$$

Here, $\alpha$ denotes the sound pressure efficiency, $e_{b\ max}$ denotes the maximum sound energy that can be generated in the emphasis area from the input signal, and $\|R_b\|^2$ denotes sound energy that can be generated from a unit input power and is a variable introduced to correspond physical quantity of a numerator and a denominator to energy.

Then, the sound pressure ratio, which is the first criterion for determining a coefficient of a filter, can be expressed as Equation 5 below by using Equation 3. Equation 5 is a ratio of an energy size (denotes sound pressure) in the emphasis area to an energy size of the suppression area.

$$\beta = \frac{e_b}{e_d} = \frac{q^H R_b q}{q^H R_d q} \quad \text{Equation 5}$$

Here, $\beta$ denotes the sound pressure ratio, and $e_d$ and $e_b$ respectively denotes energy in the suppression area and the emphasis area.

When the sound pressure efficiency of Equation 4 and the sound pressure ratio of Equation 5 are independently used, above described problems may be arisen. In other words, when only the sound pressure efficiency of Equation 4 is used as a criterion, a high sound pressure level may occur in an area besides the emphasis area, and when only the sound pressure ratio of Equation 5 is used as a criterion, sufficiently high sound pressure ratio can be calculated even when $e_b$ is very small if $e_d$, the denominator, is close to 0.

Accordingly, the embodiments of the present invention use a cost function, which adopts advantages of both criteria by determining a coefficient of a filter by combining the two criteria. A cost function is obtained by weighting each of the two criteria, and combining the weighted criteria. Such cost function can be expressed as Equation 6.

$$\gamma = \frac{e_b}{(1-\kappa)e_d + \kappa e_{bmax}} = \frac{q^H R_b q}{(1-\kappa)q^H R_d q + \kappa \|R_b\|^2 q^H q} \quad \text{Equation 6}$$

Here, $\gamma$ denotes the cost function, and a denominator of the cost function is the combination of energy $e_d$ in the suppression area, i.e. the denominator of the sound pressure ratio, and energy $e_{bmax}$ of the maximum sound that can be generated in the emphasis area from an input signal, i.e. the denominator of the sound pressure efficiency. The energy $e_d$ and the energy $e_{bmax}$ are exclusively combined around a weight coefficient K, but it is obvious to one of ordinary skill in the art that the cost function can be variously designed.

In Equation 6, the cost function $\gamma$ is adjusted based on the weight coefficient K. When the energy $e_d$ of the suppression area becomes a small value close to 0 by adjusting the weight coefficient K, the cost function $\gamma$ becomes similar to Equation 4, and thus a coefficient of a filter having high energy efficiency can be determined. Meanwhile, a high sound pressure level can be prevented from being occurred in the suppression area due to the energy $e_d$ of the suppression area in the denominator of the cost function $\gamma$.

Equation 7 below can be derived from Equation 6.

$$((1-\kappa)R_d + \kappa\|R_b\|^2 I)^{-1} R_b q = \gamma_{max} q \quad \text{Equation 7}$$

Referring to Equation 7, $\gamma_{max}$ denotes the maximum eigenvalue of a matrix $((1-\kappa)R_d+\kappa\|R_b\|^2 I)^{-1} R_b$, and a coefficient $q(\omega)$ of the filter at each frequency $\omega$ can be determined via an eigenvalue analysis method. A method of calculating an eigenvalue of a matrix and an eigenvector from Equation 7 is well known to one of ordinary skill in the art. (P. Lancaster and M. Tismenetsky, The theory of matrices, 2nd edition (Academic Press, Sandiego, 1985), pp. 282-294)

The cost function for determining a coefficient of a filter controlling a sound field has been described above, and now, a change of characteristics of the apparatus for controlling a sound field based on a change of the weight coefficient K in the cost function will be described.

Figure 5:
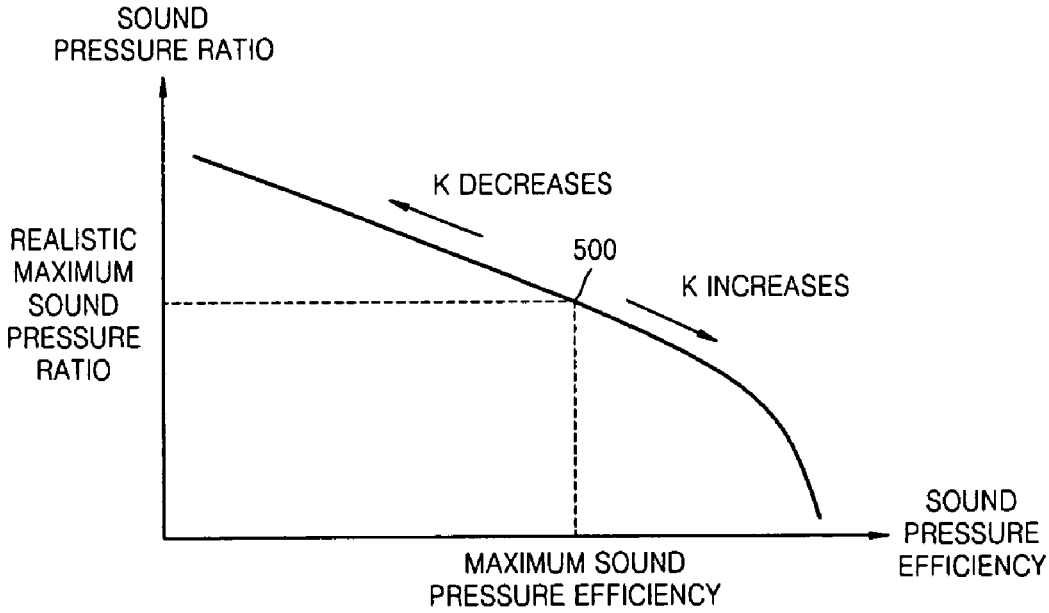
FIG. 5 is a graph for describing a method of determining a weight for a cost function in an apparatus for controlling a sound field according to an embodiment of the present invention.

FIG. 5 is a graph for describing a method of determining a weight for a cost function in an apparatus for controlling a sound field according to an embodiment of the present invention. The horizontal axis is sound pressure efficiency, which is a criteria for determining a coefficient of a filter, and the vertical axis is a sound pressure ratio, which is another criteria for determining a coefficient of a filter. The graph of FIG. 5 shows a relationship between the sound pressure efficiency and the sound pressure ratio based on a cost function.

Based on the cost function in Equation 6 above, the sound pressure efficiency and the sound pressure ratio are in a competitive relationship, i.e. an exclusive relationship, by the weight coefficient K. Accordingly in FIG. 5, when the weight coefficient K increases, the sound pressure efficiency increases while the sound pressure ratio decreases. Also, when the weight coefficient K decreases, the sound pressure efficiency decreases while the sound pressure ratio increases. The sound pressure controller 321 of FIG. 3 adjusts the weight coefficient K of the cost function so as to determine a suitable coefficient of a filter based on an environment and embodiment of the apparatus for controlling a sound field.

A value of such weight coefficient K can be determined in such a way that an array speaker system has the maximum sound pressure efficiency while having the realistic maximum sound pressure ratio. In FIG. 5, it is illustrated that a weight coefficient K corresponding to a point 500 is determined. When the weight coefficient K is determined, the weight coefficient K is inputted to Equation 6, so as to calculate a coefficient of a filter via the eigenvalue analysis method described above.

Figure 6:
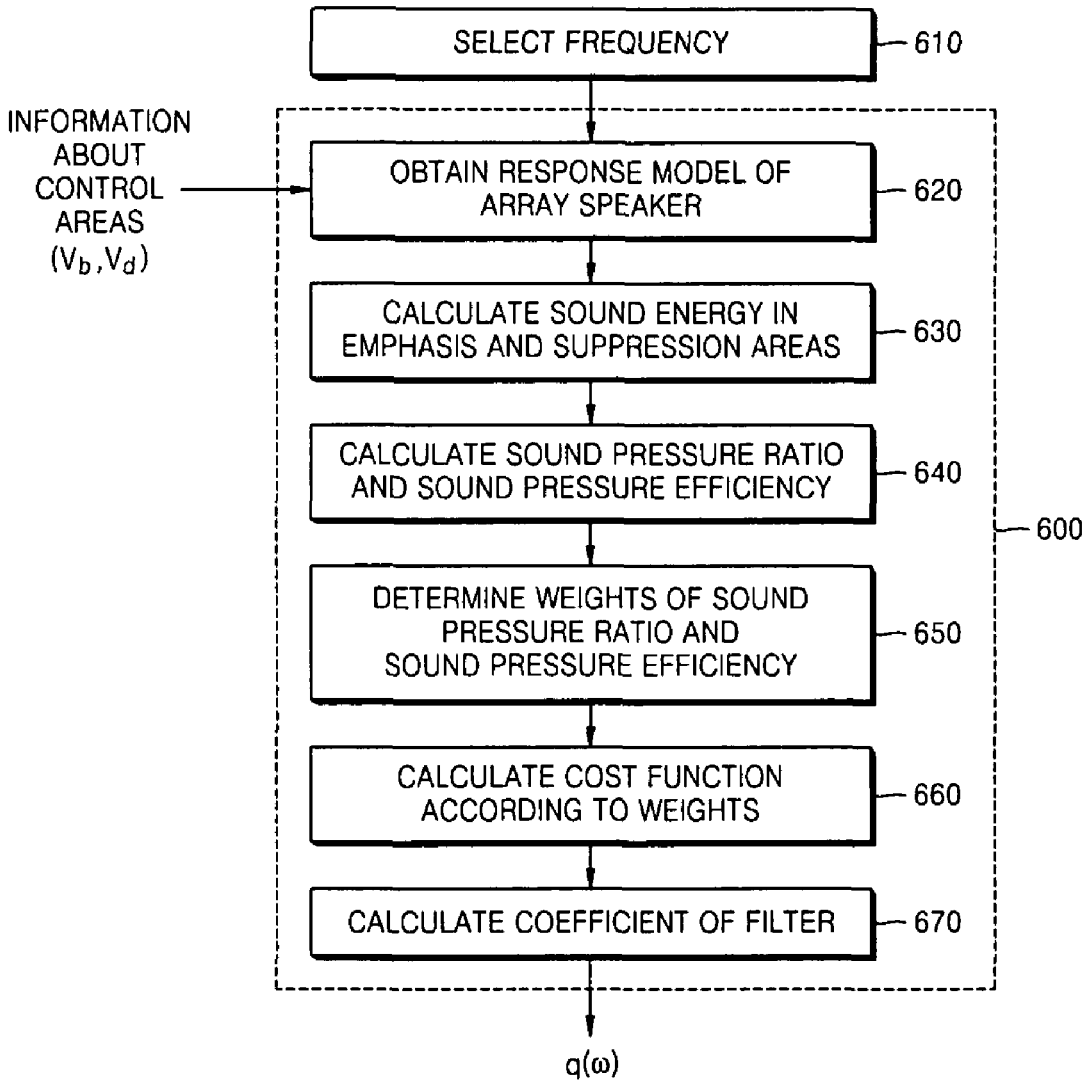
FIG. 6 is a flowchart illustrating processes of calculating a coefficient of a filter in an apparatus for controlling a sound field according to an embodiment of the present invention.

FIG. 6 is a flowchart illustrating processes of calculating a coefficient of a filter in an apparatus for controlling a sound field according to an embodiment of the present invention. The processes are applied to frequencies based on several bands of an input signal in a frequency domain. Assuming that the input signal is generally a broadband signal, the coefficient is calculated based on each frequency so as to form a spatial filter for the broadband signal.

In operation 610, a frequency of a signal in which a coefficient of a filter is to be calculated is selected from among various frequencies of a sound source signal. Operation 600 for calculating a coefficient of a filter that controls a sound field is performed for each selected frequency, and such operation 600 is shown in a dotted line in FIG. 6. Operations of operation 600 will now be described.

In operation 620, a response model, i.e. a sound transmission function from an array speaker to a predetermined field point around the array speaker, is obtained based on information about control areas that include an emphasis area and a suppression area. In operation 630, sound energy in the emphasis and suppression areas are calculated. The sound energy can be calculated by using a mathematical average of sound energy from sound pressure as described with reference to FIG. 4. In operation 640, a sound pressure ratio and sound pressure efficiency are calculated by using the sound energy calculated in operation 630. The sound pressure ratio and the sound pressure efficiency can be calculated by respectively using Equations 5 and 4. In operation 650, weights of the sound pressure ratio and the sound pressure efficiency are determined. The weights are determined in such a way that an array speaker system has the maximum sound pressure efficiency while having the realistic maximum sound pressure ratio based on the graph of FIG. 5. In operation 660, a cost function, i.e. the combination of the sound pressure ratio and the sound pressure efficiency, is calculated based on the determined weights. In operation 670, the coefficient of the filter controlling a signal corresponding to the frequency selected in operation 610 is calculated by using an eigenvalue analysis method from the calculated cost function.

The processes of calculating a coefficient of a filter for controlling sound pressure performed by the sound pressure controller 321 included in the filter coefficient calculator 320 of FIG. 3 have been described above. Now, another element of the filter coefficient calculator 320, i.e. the compensator 322, will be described.

The compensator 322 compensates the coefficient determined by the sound pressure controller 321 so that an output signal outputted from the array speaker is not distorted. As described above, the sound pressure controller 321 calculates the coefficient in the frequency domain. The output signal may be an analog signal, and thus the input signal is transformed from the frequency domain to a time domain. Here, the output signal in the time domain may be distorted or deteriorate in its sound quality. Accordingly, the compensator 322 compensates the coefficient so as to prevent such problem.

The compensator 322 compensates the distortion of the output signal is performed by generating an output signal having the same wavelength as the input signal. For example, when the input signal is in an impulse form, the compensator 322 compensates the output signal to be an impulse form. Processes of compensating the coefficient will now be described in detail.

Figure 7:
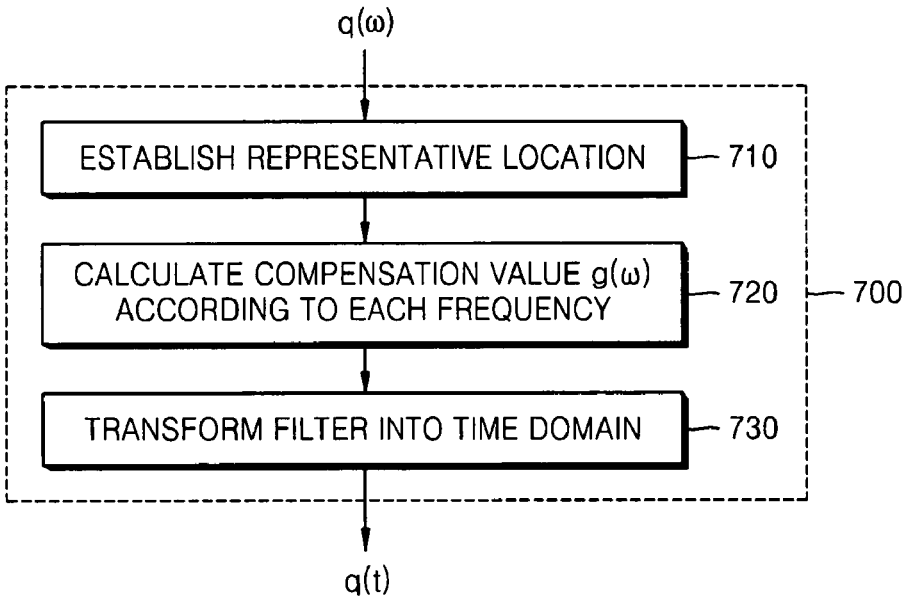
FIG. 7 is a flowchart illustrating processes of compensating a coefficient of a filter in an apparatus for controlling a sound field according to an embodiment of the present invention.

FIG. 7 is a flowchart illustrating processes of compensating a coefficient of a filter in an apparatus for controlling a sound field according to an embodiment of the present invention. The processes correspond to operation 700 in a dotted line. Each operation of operation 700 will now be described.

In operation 710, a predetermined representative location is established inside an emphasis area. The representative location is a standard location for compensating an output signal to have the same impulse form as an input signal when the output signal is transmitted to a predetermined location from an array speaker. The representative location is generally a location of a listener.

In operation 720, a compensation value is calculated so that sound pressure in a time domain of the output signal transmitted to the representative location established in operation 710 has an impulse form. Operation 720 is performed by calculating a compensation value based on each frequency so that the frequency size of sound pressure is uniform and the phase of the sound pressure is uniform or linear. The compensation value based on each frequency can be calculated by using Equation 8 below.

$$g(\omega) = \frac{1}{h(\vec{r}_{ref} \mid \vec{r}_s, \omega)q(\omega)} \qquad \text{Equation 8}$$

Here, $g(\omega)$ denotes the compensation value based on each frequency, $\vec{r}_{ref}$ denotes the representative location established in the emphasis area. Accordingly, $h(\vec{r}_{ref} \mid \vec{r}_s, \omega)$ denotes a sound transmission function, i.e. a response model, from the array speaker to the representative location, and $q(\omega)$ denotes the previously established coefficient of the filter for controlling the sound pressure. When the compensation value satisfying Equation 8 is calculated, the calculated compensation value is multiplied to the coefficient so as to compensate the coefficient. Accordingly, the compensated filter can be denoted by $g(\omega)q(\omega)$.

In operation 730, the compensated filter generates a signal whose frequency domain is transformed to a time domain via inverse fast Fourier transform (IFFT). In this process, the filter in the time domain is delayed for a predetermined time so as to correspond a reference point of the output signal. When a filter in a frequency domain is transformed to a time domain in a multichannel signal, reference points of signals in an impulse form between channels do not correspond, and thus sound outputted from the array speaker may be distorted. Such problem can be solved by aligning the reference points of the output signal and then adjusting the reference points to one value.

Operation 730 can be expressed as Equation 9 below.

$$q(t-\tau)=IFFT[g(\omega)q(\omega)] \qquad \text{Equation 9}$$

Here, $q(t-\tau)$ denotes the compensated filter in the time domain, t denotes time, and $\tau$ denotes time delay accompanied while corresponding the reference points. In other words Equation 9 shows that an output signal without distortion can be generated by transforming the compensated filter to the time domain, and then delaying the compensated filter for a predetermined time.

The processes of compensating the coefficient of the filter performed by the compensator 322 included in the filter coefficient calculator 320 of FIG. 3 have been described above. The remaining elements will now be described with reference to FIG. 2.

The signal generator 230 generates a plurality of output signals that focuses the sound on the emphasis area by filtering the output signal based on the coefficient of the filter calculated by the filter coefficient calculator 220. The output signals are calculated by convoluting the input signal and the calculated coefficient of the filter.

Then, the output unit 240 outputs the output signals generated by the signal generator 230. The output unit 240 may be an apparatus for reproducing a sound signal, such as an array speaker.

The apparatus for controlling a sound field in an array speaker has been described in detail above. According to the current embodiment of the present invention, a listener located in a predetermined direction or distance from the array speaker can clearly hear sound emitted from the array speaker by adjusting a sound field of the sound so as to focus the sound to the listener without wearing an earphone or a headset. Also, while adjusting the sound filed, a high sound pressure level difference between the emphasis area and the suppression area can be guaranteed by using the sound pressure ratio, and energy efficiency of the array speaker can be improved by using the sound pressure efficiency.

Figure 8:
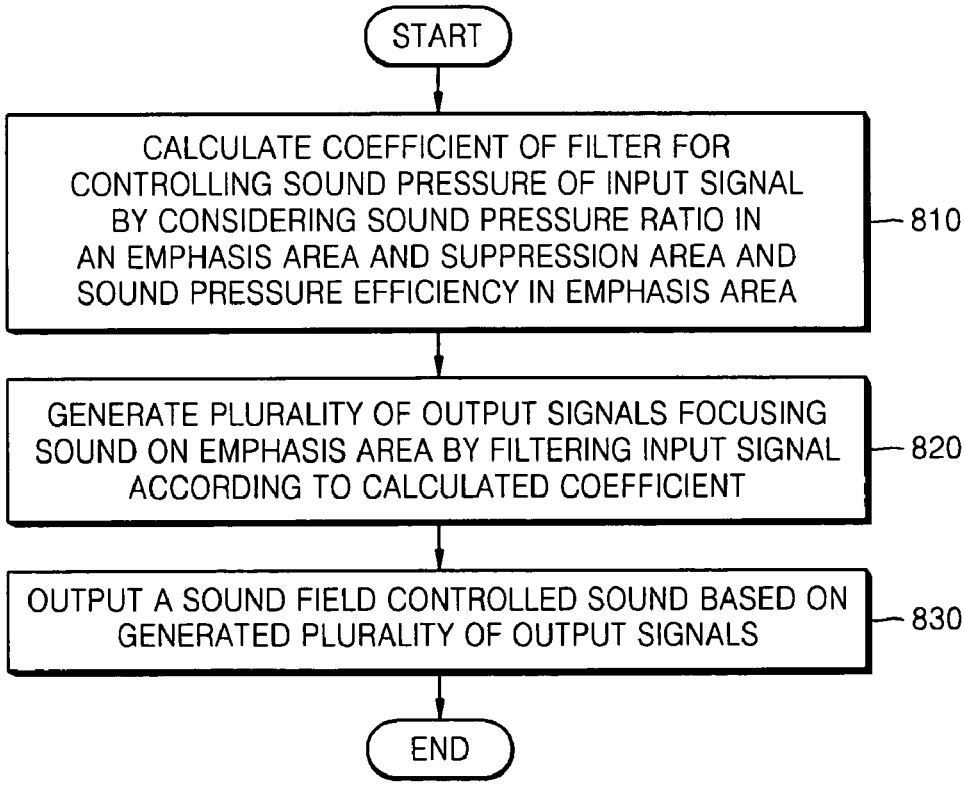
FIG. 8 is a flowchart illustrating a method of controlling a sound field in an array speaker system according to an embodiment of the present invention.

FIG. 8 is a flowchart illustrating a method of controlling a sound field in an array speaker system according to an embodiment of the present invention.

In operation 810, a coefficient of a filter for controlling sound pressure of an input signal is calculated based on a sound pressure ratio of a suppression area that suppresses sound emitted from an array speaker and an emphasis area that emphasizes the sound, and sound pressure efficiency in the emphasis area. Here, the sound pressure ratio and the sound pressure efficiency are each weighted, and the weights are determined in such a way that the array speaker system has the maximum sound pressure efficiency while having the realistic maximum sound pressure ratio based on the environment or condition of the array speaker system. Then, the sound pressure ratio and the sound pressure efficiency are combined based on the determined weights so as to calculate the coefficient of the filter for controlling sound pressure.

In operation 820, a plurality of output signals focusing the sound on the emphasis area is generated by filtering the output signal based on the coefficient calculated in operation 810.

In operation 830, a sound field controlled sound based on the plurality of output signals is outputted.

According to the embodiments of the present invention, a listener in a predetermined direction and distance from an array speaker can clearly hear sound emitted from the array speaker by adjusting a sound field.

The invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing the present invention can be easily construed by programmers skilled in the art to which the present invention pertains.

While this invention has been particularly shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A method of controlling a sound field, the method comprising:

calculating a coefficient of a filter that controls sound pressure of an input signal, based on a sound pressure ratio of a suppression area that suppresses sound emitted from an array speaker and/or an emphasis area that emphasizes the sound, and sound pressure efficiency in the emphasis area;

generating a plurality of output signals that focuses the sound to the emphasis area by filtering the input signal based on the calculated coefficient of the filter; and outputting a sound field controlled sound based on the generated plurality of output signals.

2. The method of claim 1, wherein the calculating of the coefficient comprises controlling the sound pressure of the input signal by determining the coefficient by combining the sound pressure ratio and the sound pressure efficiency calculated from a response model between the array speaker and the suppression and emphasis areas.

3. The method of claim 2, wherein the controlling of the sound pressure comprises:

calculating a cost function by controlling the sound pressure ratio and the sound pressure efficiency calculated from the response model by weighting the sound pressure ratio and the sound pressure efficiency; and determining the coefficient based on the calculated cost function.

4. The method of claim 1, wherein the calculating of the coefficient comprises compensating the coefficient so that the output signal is not distorted.

5. The method of claim 4, wherein the compensating of the coefficient comprises:

establishing a predetermined representative location in the emphasis area;

calculating a compensation value based on each frequency so that the frequency size of the sound pressure is uniform and the phase of the sound pressure is uniform or linear in the established predetermined representative location; and multiplying the calculated compensation value to the determined coefficient.

6. The method of claim 4, further comprising corresponding the compensated coefficient to a reference point of the output signal by transforming the compensated coefficient to a time domain and then delaying the compensated coefficient as a predetermined time.

7. The method of claim 1, wherein the sound pressure ratio is a ratio of the sound pressure in the emphasis area to the sound pressure in the suppression area, and the sound pressure efficiency is a ratio of a size of the sound pressure in the emphasis area to a size of the input signal.

8. The method of claim 1, further comprising establishing the suppression area and the emphasis area in areas around the array speaker.

9. A computer readable recording medium having recorded thereon a program for executing the method of claim 1.

10. An apparatus for controlling a sound field for an array apparatus, the apparatus comprising:

a filter coefficient calculator, which calculates a coefficient of a filter that controls sound pressure of an input signal, based on a sound pressure ratio of a suppression area that suppresses sound emitted from the array speaker and an emphasis area that emphasizes the sound, and sound pressure efficiency in the emphasis area;

a signal generator, which generates a plurality of output signals that focuses the sound to the emphasis area by filtering the input signal based on the calculated coefficient of the filter; and the array speaker, which outputs a sound field controlled sound using the generated plurality of output signals.

11. The apparatus of claim 10, wherein the filter coefficient calculator comprises a sound pressure controller, which controls the sound pressure of the input signal by determining the coefficient by combining the sound pressure ratio and the sound pressure efficiency calculated from a response model between the array speaker and the suppression and emphasis areas.

12. The apparatus of claim 11, wherein the sound pressure controller calculates a cost function by controlling the sound pressure ratio and the sound pressure efficiency calculated from the response model by weighting the sound pressure ratio and the sound pressure efficiency, and determines the coefficient based on the calculated cost function.

13. The apparatus of claim 10, wherein the filter coefficient calculator comprises a compensator, which compensates the coefficient so that the output signal is not distorted.

14. The apparatus of claim 13, wherein the compensator establishes a predetermined representative location in the emphasis area, calculates a compensation value based on each frequency so that the frequency size of the sound pressure is uniform and the phase of the sound pressure is uniform or linear in the established predetermined representative location, and multiplies the calculated compensation value to the determined coefficient.

15. The apparatus of claim 13, further comprising a transformer, which corresponds the compensated coefficient to a reference point of the output signal by transforming the compensated coefficient to a time domain and then delaying the compensated coefficient as a predetermined time.

16. The apparatus of claim 10, wherein the sound pressure ratio is a ratio of the sound pressure in the emphasis area to the sound pressure in the suppression area, and the sound pressure efficiency is a ratio of a size of the sound pressure in the emphasis area to a size of the input signal.

17. The apparatus of claim 10, further comprising a control area establisher, which establishes the suppression area and the emphasis area in areas around the array speaker.

* * * * *